US008690744B2

(12) United States Patent
Harms et al.

(10) Patent No.: US 8,690,744 B2
(45) Date of Patent: Apr. 8, 2014

(54) METHOD FOR PRODUCING CIGARETTE PACKS

(75) Inventors: Stefan Harms, Hamburg (DE); Sylvia Rose, Quickborn (DE); Wolfgang Rohwedder, Hamburg (DE)

(73) Assignee: Focke & Co., Verden (DE)

( * ) Notice: Subject to any disclaimer, the term of this patent is extended or adjusted under 35 U.S.C. 154(b) by 313 days.

(21) Appl. No.: 12/995,611

(22) PCT Filed: Apr. 21, 2009

(86) PCT No.: PCT/EP2009/002899
§ 371 (c)(1),
(2), (4) Date: Jan. 31, 2011

(87) PCT Pub. No.: WO2009/146766
PCT Pub. Date: Dec. 10, 2009

(65) Prior Publication Data

US 2011/0118098 A1 May 19, 2011

(30) Foreign Application Priority Data

Jun. 6, 2008 (DE) ..... 10 2008 027 259

(51) Int. Cl.
*B31B 1/62* (2006.01)
*B31B 49/02* (2006.01)

(52) U.S. Cl.
USPC ..... 493/128; 493/264; 493/150; 493/266

(58) Field of Classification Search
USPC ..... 493/128, 264, 150, 266
See application file for complete search history.

(56) References Cited

U.S. PATENT DOCUMENTS 4,121,756 A 10/1978 Focke
4,157,149 A 6/1979 Moen (Continued)

FOREIGN PATENT DOCUMENTS

CN 1517274 A 8/2004
DE 19814932 11/1999

(Continued)

OTHER PUBLICATIONS

European Search Report on related patent application (Aug. 29, 2012).

(Continued)

*Primary Examiner* — Hemant M Desai
(74) *Attorney, Agent, or Firm* — Laurence P. Colton; Smith Risley Tempel Santos LLC

(57) ABSTRACT

The invention relates to a method and to an apparatus for producing packs, in particular cigarette packs, from blanks (11, 44), wherein individual regions of a pack blank (11) are adhesively bonded to one another and, if appropriate, to one or more separate blanks (44) by the pack blank (11) being provided with individual portions of glue (28, 29) by means of a valve or a group of valves (26) and blank regions which are to be adhesively bonded together subsequently being held or pressed on one another, wherein the individual portions of glue (28, 29) are applied to the blank regions by means of the glue valve (27) or the group of glue valves (26), and/or wherein a control and/or regulating device (65) automatically controls and/or regulates the size or quantity of the respectively produced portion of glue (28, 29), which size or quantity is produced by the at least one glue valve (27) during an individual valve opening cycle, as a function of at least one parameter.

2 Claims, 5 Drawing Sheets

(56) References Cited

U.S. PATENT DOCUMENTS

| | | | | |
|---|---|---|---|---|
| 4,219,150 | A | 8/1980 | Focke | |
| 4,891,249 | A | 1/1990 | McIntyre | |
| 4,997,504 | A * | 3/1991 | Wood | 156/204 |
| 5,194,114 | A * | 3/1993 | Walter | 156/442.1 |
| 5,895,553 | A * | 4/1999 | Spada | 156/543 |
| 6,878,224 | B1 * | 4/2005 | Focke et al. | 156/204 |
| 2002/0022080 | A1 * | 2/2002 | Collin et al. | 427/8 |
| 2003/0148018 | A1 | 8/2003 | Hoffmann | |
| 2007/0090132 | A1 | 4/2007 | Williams et al. | |

FOREIGN PATENT DOCUMENTS

| | | | |
|---|---|---|---|
| DE | 60006258 | | 7/2004 |
| DE | 202004009389 | | 8/2004 |
| DE | 69632795 | | 7/2005 |
| DE | 69825834 | | 9/2005 |
| DE | 60033761 | | 11/2007 |
| DE | 102006047812 | | 7/2008 |
| EP | 0920919 | A1 | 6/1999 |
| EP | 1437303 | | 12/2003 |
| EP | 1437303 | | 7/2004 |
| EP | 1437303 | A2 | 7/2004 |
| WO | 03/076269 | | 9/2003 |

OTHER PUBLICATIONS

EP Search Report, Mar. 10, 2011.

State Intellectual Property Office of the People's Republic of China, Notification of the Second Office Action (for a related patent application), Aug. 27, 2013.

* cited by examiner

METHOD FOR PRODUCING CIGARETTE PACKS

STATEMENT OF RELATED APPLICATIONS

This patent application is the US PCT Chapter II National Phase and claims the benefit of PCT/EP2009/002899 having an International Filing Date of 21 Apr. 2009, which claims priority from German Patent Application No. 10 2008 027 259.0 having a filing date of 6 Jun. 2008.

BACKGROUND OF THE INVENTION

1. Technical Field

The invention relates to a method for producing packs, in particular cigarette packs, from blanks, wherein individual regions, in particular folding tabs, of a pack blank are connected to one another and, if appropriate, to one or more separate blanks by the pack blank and/or the separate blank being provided in regions with individual, spatially separated portions of glue, in particular drops of glue, by means of a glue valve or a group of glue valves and the blank regions which are to be adhesively bonded together subsequently being held or pressed on one another. The invention furthermore relates to an apparatus for carrying out the method and to a valve which can be used preferably within the context of the method and as part of the apparatus. The valve here has a valve housing, an outlet or valve opening and a closure element with which the valve can be moved to and fro between an open position and a closed position.

2. Prior Art

During the production of cigarette packs, individual regions of the respective blank are adhesively bonded to one another. In addition, separate blanks, for example a collar or an internal blank in which the cigarette block is wrapped are generally glued to the blank. For this purpose, it is known to provide individual regions of the blank with individual portions of glue, in particular spots of glue, using glue valves.

However, during the adhesive bonding together of the blank regions, contamination of the glue frequently occurs. This is primarily because the glue valves apply too much glue in small regions of the blank. When the regions which are to be adhesively bonded together are pressed onto one another, the excess glue undesirably passes to the outside and contaminates other regions of the blank.

Furthermore, it is disadvantageous in the known gluing of cigarette pack blanks that the constant size or quantity of the glue portion which is set at the glue valves and is produced during a valve opening cycle changes inadvertently over the course of the production process. This is because the glue is inadvertently heated over the course of the production process by the waste heat of the packaging machine. This results in a reduction in the glue viscosity. At the beginning of production when all of the machine parts are still cold, the glue therefore has a greater viscosity than after a certain period of production. However, an inadvertently greater portion of glue quantity of the glue emerging from the valve during an individual opening cycle follows from a lower glue viscosity when the valve settings are otherwise unchanged.

BRIEF SUMMARY OF THE INVENTION

Taking this prior art as the starting point, it is the object of the present invention to specify a method and an apparatus of the type mentioned at the beginning, with which the blanks can be glued as precisely as possible. It is furthermore the object of the present invention to specify a valve which can be used for this purpose.

This object is achieved by a method for producing packs, in particular cigarette packs, from blanks, wherein individual regions, in particular folding tabs, of a pack blank are connected to one another and, if appropriate, to one or more separate blanks by the pack blank and/or the separate blank being provided in regions with individual, spatially separated portions of glue by means of one or more glue valves and the blank regions which are to be adhesively bonded together subsequently being held or pressed on one another, characterized in that the individual, spatially separated portions of glue for adhesively bonding together the individual blank regions are applied in a targeted manner in at least two different portion sizes or quantities of glue to the respective pack blank and/or to the respective separate blank, a method for producing packs, in particular cigarette packs, from blanks, wherein individual regions of a pack blank are adhesively bonded to one another and, if appropriate, to one or more separate blanks by the pack blank being provided with individual portions of glue by means of a valve or a group of valves and blank regions which are to be adhesively bonded together subsequently being held or pressed on one another, characterized in that the individual portions of glue are applied to the blank regions by means of the glue valve or the group of glue valves, a control and/or regulating device automatically controlling and/or regulating the size or quantity of the respectively produced portion of glue, which size or quantity is produced by the at least one glue valve during an individual valve opening cycle, as a function of at least one parameter, an apparatus for producing packs of blanks, in particular for carrying out the method disclosed herein, with a conveyor with which blanks can be conveyed along for application of glue at a glue valve or at a plurality of glue valves of a glue valve group, and with a control and/or regulating device for controlling and/or regulating the glue valve or the glue valve group, characterized in that the control and/or regulating device is designed in such a manner that the size or quantity of the respective portion of glue, which size or quantity is produced by the at least one glue valve, can be controlled and/or regulated automatically as a function of at least one parameter, and by a valve for flowable media, in particular glue valve, with a valve housing, an outlet or valve opening and a closure element with a closing body with which the valve can be moved to and/or fro between an open position and a closed position, characterized in that the valve has at least one sensor for measuring the viscosity of the flowable medium and/or for measuring at least one measurement variable influencing the viscosity of the flowable medium and/or for measuring at least one measurement variable influenced by the viscosity of the flowable medium.

According thereto, the method according to the invention for producing cigarette packs is characterized in that the individual, spatially separated portions of glue—in particular drops of glue—for adhesively bonding together the individual blank regions are applied to the respective pack blank and/or to the respective separate blank in a targeted manner in at least two different portion sizes or portion quantities. It is therefore possible for, for example, smaller portion sizes, i.e. smaller quantities of glue, to be applied in critical regions of the blank, in particular in border regions, than further inward on the blank. Accordingly, the risk is reduced of glue being pressed to the outside or passing to the outside when the blank regions which are to be adhesively bonded to one another are held on one another.

In this embodiment of the invention, the portions of glue which are spatially separated on the blank accordingly each have different quantities of glue or sizes of glue. Said individual, spatially separated portions are advantageously each produced only within a single valve opening cycle. Starting from the closed valve, an opening cycle here comprises opening the valve once followed by closing thereof. However, as an alternative, in this embodiment of the invention, provision may in principle also be made to produce the individual, separate portions of glue in each case by repeated opening of the valve.

In an independent embodiment of the invention, the portions of glue are applied to the blank regions by means of the glue valve or the group of glue valves. In this case, a control and/or regulating device automatically controls and/or regulates the size or quantity of the respectively produced portion of glue, which size or quantity is produced by the at least one glue valve during an individual valve opening cycle, specifically as a function of at least one parameter.

In this embodiment, the quantity or the size of the respective portion of glue therefore relates to the portion quantity or the portion size which is produced during an individual opening cycle which, starting from the closed valve, comprises opening of the valve once followed by closing thereof.

The parameter, as a function of which the size or quantity of the portions of glue produced is controlled and/or regulated is preferably a measurement variable which is measured continuously or in predetermined time intervals and influences the size or quantity of the portion of glue.

In a further development of the invention, this is at least one measurement variable influencing the viscosity of the glue and/or at least one measurement variable influenced by the viscosity of the glue. The measurement variable in this case is advantageously the temperature of the glue supplied to the glue valve or located in the glue valve, and/or the pressure downstream of a feed pump, under which pressure the glue is supplied to the glue valve.

In addition or as an alternative, the measurement variable may be a characteristic variable which characterizes movements of a closure element which at least partially moves within the glue in the glue valve.

As far as the abovementioned closure element is concerned, said closure element moves to and/or fro as a rule between a closed position preventing the outlet of glue from the valve and an open position permitting the outlet of glue. In order suitably to control and/or regulate the respective size of the portion of glue, the period of time in which the closure element is in the open position is therefore advantageously controlled and/or regulated as a function of the abovementioned measurement variable which influences the viscosity of the glue or is influenced by the viscosity of the glue.

A valve for flowable media, which can be used for a method of this type, has a valve housing, an outlet or valve opening and the closure element with which the valve can be moved to and/or fro between the open position and the closed position. The valve is characterized by at least one sensor for measuring the viscosity of the flowable medium, for example glue, and/or for measuring the at least one measurement variable influencing the viscosity of the flowable medium and/or for measuring the at least one measurement variable influenced by the viscosity of the flowable medium. Of course, a valve of this type can be used not only for glue but for all flowable media having a variable viscosity.

In a preferred embodiment, the sensor of the valve is a temperature sensor with which the temperature of the flowable medium or glue in the valve can be measured, and/or a sensor for detecting at least one characteristic variable which characterizes the movements of the closure element of the valve, which closure element moves within the medium. Preferably, in addition or else as an alternative, the valve here can have an acceleration sensor with which accelerated movements of the closure element within the valve housing of the valve can be detected.

BRIEF DESCRIPTION OF THE DRAWINGS

Further features of the invention emerge from the attached dependent claims, the description below of a preferred exemplary embodiment and from the attached drawings, in which:

DETAILED DESCRIPTION OF PREFERRED EMBODIMENTS

Figure 1:
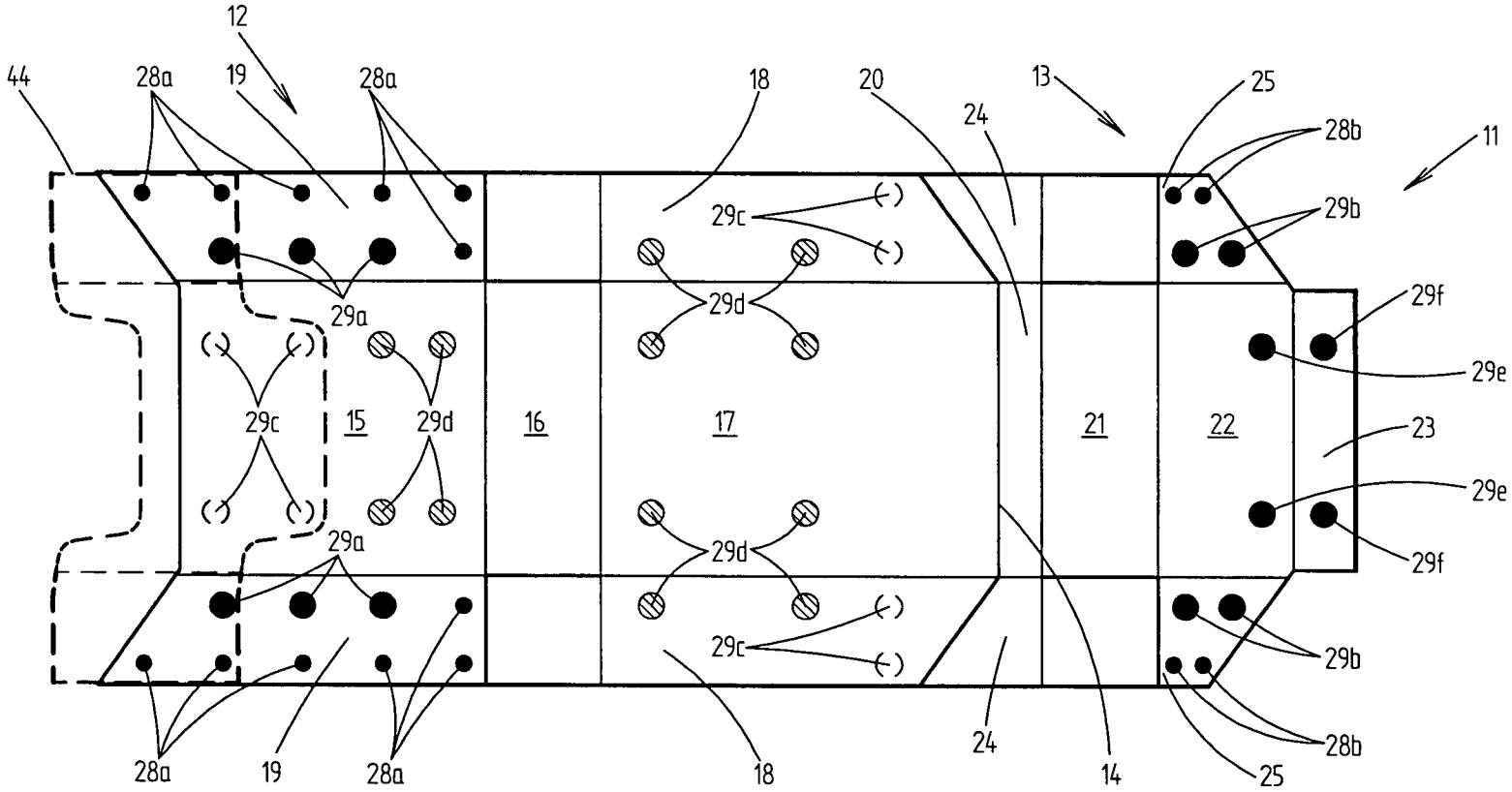
FIG. 1 shows a spread-out blank for a cigarette pack, namely a hinge-lid box with imprinted spots of glue.

The details illustrated in the drawings are concerned with the manufacturing of packs 10, namely cigarette packs of the hinge-lid box type consisting of blanks.

A pack 10 essentially consists of a pack blank 11 according to FIG. 1 made of (thin) cardboard. The pack 10 here has a lower box part 12 and a lid 13. The lid 13 is connected to the lower box part 12 via a line joint 14.

The relevant pack blank 11 forms surfaces, marked by folding lines, for a front wall 15, a bottom wall 16, a rear wall 17 and internal side tabs 18 and external side tabs 19. In order to form the lid 13, the blank 11 consists of a lid rear wall 20, an end wall 21 and a lid front wall 22. The latter is adjoined by a lid inner tab 23 which is folded over toward the inside of the lid front wall 22 and is connected to the latter. In order to form lid side walls, inner lid side tabs 24 and outer lid side tabs 25 are provided.

The blank 11 is fully premanufactured. An outside of the finished pack 10 is customarily provided with extensive printing. An inside of the blank 11 is unprinted.

During the manufacturing, the pack blank 11 is provided with individual, spatially separated portions of glue, namely spot-like drops of glue, by a group 26 of glue valves 27. A particular characteristic of the invention is that here, in contrast to the prior art, spots of glue of different drop size or drop quantity are used.

In the embodiment of FIG. 1, use has been made of two different drop sizes, namely larger spots of glue 29 and smaller spots of glue 28.

The spots of glue 28*a*, 29*a* in the region of the outer side tabs 19 and correspondingly the spots of glue 28*b*, 29*b* in the region of the outer lid side tabs 25 serve to connect the side tabs 19, 25 to the associated, inner side tabs 18 and 24, respectively.

Four spots of glue 29*c* which serve to fix a separate blank 44, namely a "collar", to the pack blank 11 are arranged in the region of the front wall 15 of the box part 12. The collar 44 is furthermore fixed by means of spots of glue 29*c* arranged on the interior side tabs 18. Further spots of glue 29*d* in the region of the front wall 15 and in the region of the rear wall 17 and of the interior side tabs 18 hold the pack contents, namely a separate interior blank (not illustrated) which surrounds a group of cigarettes and customarily consists of silver foil.

To adhesively bond the lid inner tab 23 to the lid front wall 22, spots of glue 29*e* are applied in the region of the lid front wall 22 and, correspondingly thereto, spots of glue 29*f* are applied in the region of the lid inner tab.

It is particularly important that the smaller spots of glue 28 are applied in various border regions of the pack blank 11 while the larger spots of glue 29 are primarily arranged further inward on the blank 11. This is intended in particular to prevent there being excess adhesive in the border regions when the individual regions which are to be adhesively bonded together are held or pressed on one another, said adhesive penetrating to the outside and in particular contaminating the printed side of the pack blank 11.

According to the invention, smaller drops of glue 28 are advantageously used wherever the type of surfaces which are to be in each case adhesively bonded to one another makes this necessary.

Figure 2:
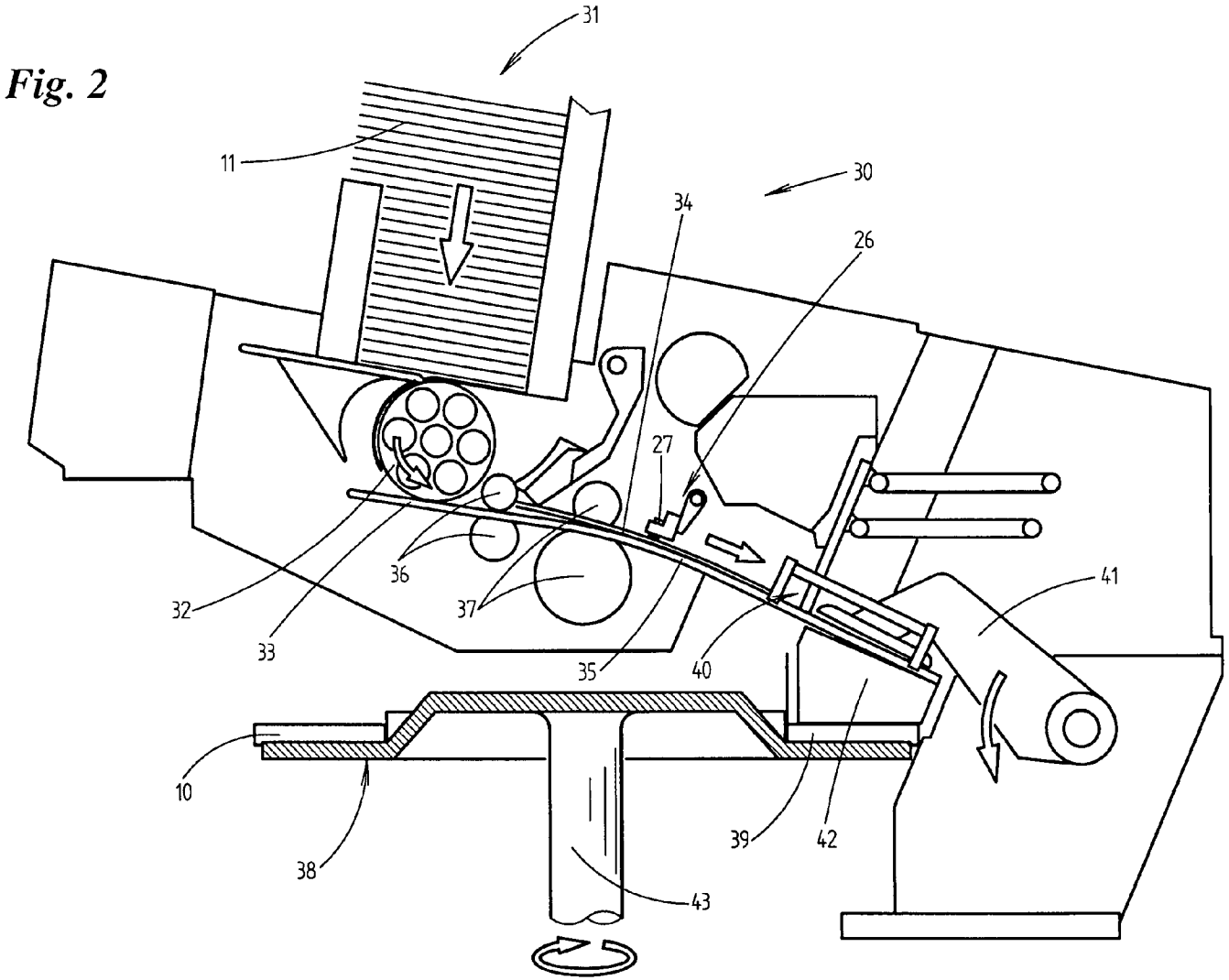
FIG. 2 shows, in side view (partial section) a blank unit of a packaging machine for producing hinge-lid boxes.

FIG. 2 shows that part of a packaging machine for producing cigarette packs 10 at which the drops of glue 28, 29 of different size are applied to the individual blanks 11, namely a "blank unit" 30.

The pack blanks 11 from a magazine 31 of the blank unit 30 are separated by means of a separating device, namely a rotating rolling wheel 32. For this purpose, suction openings which are subjected to negative pressure are arranged on the circumferential surface of the rolling wheel 32. The rolling wheel 32 is arranged below the blank magazine 31 and, during rotation, in each case entrains the lowermost blank 11 of the magazine 31 by means of suction of said blank and transfers said blank over the course of a (partial) rotation to a first pair of conveying rollers 36. The first pair of conveying rollers 36 and a following, further pair of conveying rollers 37 convey the blank 11 along a conveyor track 33 which is inclined slightly in relation to the horizontal and is arranged below the rolling wheel 32.

The blanks 11 are stacked one above another within the magazine 31, with a side of the blank 11 which is customarily printed pointing upward in each case. After the respective blank 11 is deposited on the conveyor track 33, the unprinted side of the blank 11 points upward.

The conveyor track 33 has an upper guide 34 and a lower guide 35. Between the upper guide 34 and the lower guide 35, the individual blanks 11 are conveyed further successively over the further course by means of the pair of conveying rollers 37 until said blanks pass into the region of a folding turret 38.

Before reaching the folding turret 38, i.e. at the beginning of the conveying movement on the conveyor track 33, consecutive blanks 11 are provided downstream of the second pair of conveying rollers 37 with the drops of glue 28, 29. For this purpose, the glue valve group 26 of glue valves 27 is positioned above the upper guide 34. The glue valve group is part of a glue application device which will be described in more detail further on.

After the individual drops of glue 28, 29 have been applied, the blanks 11 to which glue has been applied are transported in a manner known per se in the direction of the folding turret 38 until the respective blank 11 is located above a pocket 39 of the folding turret 38. The respective blank 11 is aligned by means of an adjusting arm 40 and is subsequently pressed into the pocket 39 along folding walls 42 of a folding shaft by a punch 41. During cyclical rotation of the folding turret 38 about a central shaft 43, the blank 11 is guided to different folding stations which are arranged along an arc of a circle and in which complex folding operations are carried out in a manner which is likewise known per se. In particular, blocks of cigarettes which are wrapped by blanks originating from silver foil reels are supplied here. Furthermore, the respective pack collar 44 is introduced there into the folding process. Those blank regions of each blank 11 which are provided with glue are folded in the manner already described above and are already partially adhesively bonded to one another. After leaving the folding turret 38, the respective blanks 11 are already in a substantially finally folded state and are supplied to a folding diverter station (not illustrated). The final folding and adhesive bonding operations are carried out there.

Figure 3:
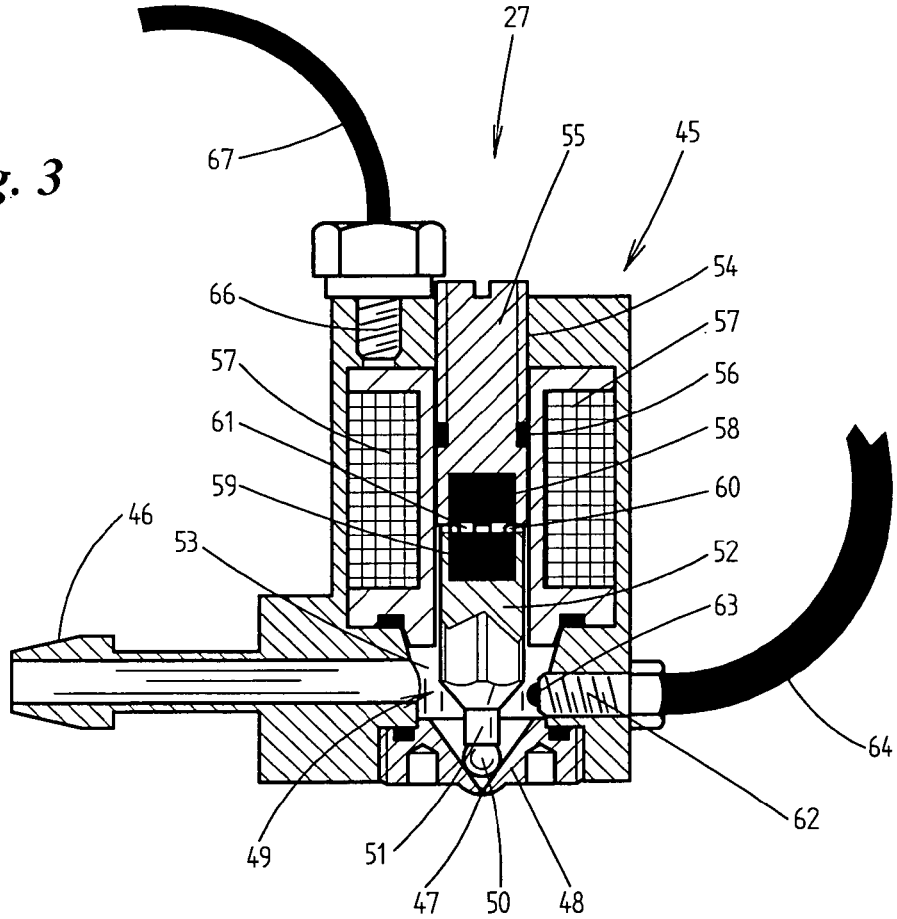
FIG. 3 shows a vertical section through a glue valve of the blank unit from FIG. 2.

The glue application device, in particular the valve group 26 of the glue application device, is formed in a particular manner. FIG. 3 shows an individual glue valve 27 of the glue valve group 26. Said glue valve has a valve housing 45 to which a flowable medium, in this case glue, is supplied via a glue line 46. The individual portions of glue can emerge from a lower valve opening 47 which is bounded by a conical valve seat 48. A movable closure element 49 interacts with the valve seat 48. The closure element 49 has a closing body 50 facing the valve seat 48 or the valve opening 47. Said closing body 50 is of spherical design. When the valve opening 47 is closed, the closing body 50 is kept in tight contact with the valve seat 48. The closing body 50 is connected via an intermediate piece 51 to a piston piece 52 as part of the closure element 49. The piston piece 52 and therefore the closure element 49 are movable within the valve housing 45 in the direction of the valve seat 48 and back, i.e. are movable to and/or fro and up and down.

A valve chamber 53 into which the glue line 46 leads and from which glue emerges via the valve opening 47 when the valve is open is formed above the valve seat 48.

The valve housing 45 is provided with a continuous interior space 54 which is open on the side facing the valve opening 47 and is round in cross section. Said interior space is closed to the outside, specifically by means of a threaded bolt 55 with a seal 56. The adjustable threaded bolt 55 is at the same time a stop for the to and/or fro movements of the closure element 49.

The closure element 49 is movable into the closed position by means of an actuating element and into the open position by means of a counter means. The actuating element is preferably effective continuously such that the closed position of the valve or of the closing piece 50 is the normal position. The restoring element for moving the closure element 49 into the open position is a solenoid 57 which surrounds the closure element 49 at least in a subregion. The metallic piston piece 52 acts within a coil of the solenoid 57 as the core thereof. Accordingly, when current is supplied, a magnetic force is transmitted to the piston piece 52 and, as a result, the closure element 49 is moved as a whole into the open position.

The closure element 49 is preferably acted upon permanently in the closing direction by means of a closing means. In the present exemplary embodiment, said closing means is designed as a permanent magnet which exerts a permanent magnetic force on the closure element 49 in the direction of a closing movement. The permanent magnet consists of two individual magnets 58, 59, of which one is attached fixedly to the valve housing 45 and the other to the closure element 49. In the present case, the individual magnet 58 is attached to the end region of the threaded bolt 55, specifically in the region of the end surface facing the piston piece 52. The individual magnet 58 sits in a recess or depression in the end region of the threaded bolt 55, specifically in a manner slightly offset back from the end surface of the threaded bolt 55. The individual magnet 58 is protected as a result.

The other individual magnet 59 is attached in an analogous manner to the (upper) end of the piston piece 52 or is embedded into a corresponding recess. Accordingly, even when the glue valve is open, the individual magnets 58, 59 are at a (small) distance from each other.

The mutually adjacent permanent magnets 58, 59 are positioned in such a manner that identical poles, for example the north poles, face one another. As a result, by means of the permanent individual magnets 58, 59, a repelling force is permanently transmitted to the closure element 49 such that the latter is acted upon in the closed position. The opening movement by the solenoid 57 overcomes said permanent closing force.

Medium or glue may pass into the region of the permanent magnets 58, 59. The region of the closure element 49 or of the piston piece 52 thereof is provided with a polygonal or approximately hexagonal outer contour such that cavities are produced in relation to the cylindrical interior space 54, through which cavities glue can pass into the region of the individual magnets 58, 59. A spacer piece 60 at the upper end of the piston piece 52 is provided with radially directed passage openings or interruptions 61 which permit the passage of glue such that the latter can flow off again out of the region in question. Instead of a spacer piece 60 with interruptions 61, it is possible to provide a plurality of spacers which, like the spacer piece 60, ensure the minimum spacing between the two individual magnets 58, 59.

The valve can be provided with a single, central valve opening 47. As an alternative, a plurality of valve or nozzle openings may be present.

It is particularly important for the valve 27 to furthermore have a temperature sensor 62. The latter is positioned in such a manner that the measuring head 63 of the temperature sensor 62 projects into the valve chamber 53. In other words, the temperature sensor 62 is positioned in such a manner that the temperature of the glue in the valve chamber 53 can be measured. The temperature sensor 62 is connected by a cable connection 64 to a control and/or regulating device 65 which controls and/or regulates the glue valve 27.

Furthermore, the valve 27 has an acceleration sensor 66. The acceleration sensor 66 projects from the upper side of the valve 27 into the upper housing wall of the valve 27. It is arranged in such a manner that it can detect acceleration movements undertaken by the closure element 49 within the context of the opening and closing movements. The acceleration sensor 66 is connected to the control and/or regulating device 65 by a cable connection 67.

The valve 27 is controlled and/or regulated as a function of the measurement results detected by the sensors 62, 66. This is explained in more detail below with reference to FIG. 5.

The spots of glue 28, 29 of different size are applied to the respective blank 11 by the glue valve group 26. For this purpose, the glue valve group 26 has six glue valves 27 arranged in a row transversely with respect to the longitudinal extent of the blank. In this case, the individual glue valves 27 are each constructed in the manner of the glue valve 27 shown in FIG. 3. Each of the glue valves 27 is fastened to a common carrier 68 of the glue valve group 26. The glue valve group 26 and therefore each individual glue valve 27 is supplied with glue via a common glue feed 69. Individual branch lines run in the interior of the group carrier 68, said branch lines guiding the glue from the central common glue feed 69 to the individual glue valves 27, in particular to the respective glue lines 46 of the glue valves 27.

Glue is supplied by means of a feed pump 70 of the glue application device, which feeds glue out of a reservoir (not illustrated) in the direction of the group valve 26. A pressure regulator 71 arranged downstream of the feed pump 70 permits a suitable working pressure to be set. The current actual pressure can be read by means of a pressure sensor 72 arranged downstream of the pressure regulator 71.

Respective control lines 73 lead from the individual valves 27 of the valve group 26 to corresponding outlets of the control and/or regulating device 65. In the present exemplary embodiment, the control signals are transmitted to the glue valves 27 by cable. In principle, of course, it is also conceivable to transmit the control signals wirelessly.

Current is supplied to the individual glue valves 27 by a separate current source (not illustrated).

According to the invention, the sizes of the spots of glue 28, 29 which are produced by the glue valves 27 are automatically controlled and/or regulated as a function of at least one parameter. Specifically, in the present case, two measurement variables which are influenced by the viscosity of the glue or are dependent thereon are measured.

This firstly involves the glue temperature measured by the temperature of the respective temperature sensor 62. Secondly, accelerated movements of the closure element 49 are detected by the acceleration sensor 66.

Figure 4:
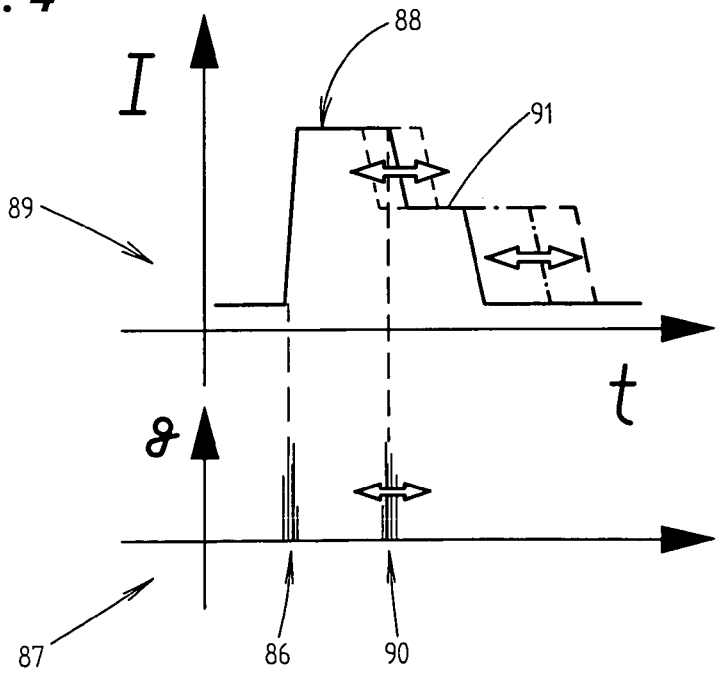
FIG. 4 shows a current/time diagram which shows the current strength of the electric current through a solenoid of the glue valve from FIG. 3.

All of the relationships are explained in more detail with reference to FIGS. 3, 4 and 5:

As the glue valve 27 starts to open, the closure element 49 is moved upward accelerated by the magnetic force brought about by the solenoid 57, i.e. the closure element 49 is accelerated from the zero speed to a certain final speed. The acceleration sensor 66 registers this acceleration—initial acceleration 86 in the acceleration/time diagram 87 of FIG. 4.

In order to make the entire, at least initially accelerated opening movement of the closure element 49 through the viscous glue possible, the closure element 49 is first of all acted upon by a first, comparatively greater force—opening force. For this purpose, an electric current 88 of a certain, comparatively greater strength—opening current—flows through the solenoid 57 bringing about the opening force acting on the closure element 49, cf. the current strength/time diagram of FIG. 4.

At the end of the opening movement, the closure element 49 strikes against the threaded bolt 55, namely against the lower side thereof. The closure element 49 is therefore braked at the stop moment, i.e. is accelerated negatively to the zero speed. The acceleration sensor 66 also measures this acceleration movement—negative final acceleration 90.

In order now to keep the closure element 49 in this open position, a holding force which is lower than the opening force merely needs to be applied. For this purpose, the current flow through the solenoid 57 can be reduced after the closure element 49 strikes against the threaded bolt 55. Accordingly, only a current 91 of lower strength in relation to the opening current 88 and referred to below as the holding current 91 now flows.

In order subsequently to return the valve 27 into the closed position, the flow of current through the solenoid 57 is prevented, i.e. reduced to zero.

Since the closure element 49 is moved within the glue, the movements of said closure element naturally depend directly on the viscosity of the glue. Specifically, in the present case, the viscosity-dependent period of time required by the closure element 49 in order to be moved from the closed position into the open position is measured by means of the acceleration sensor. Said period of time—opening time—can be determined by measurement of the time t which passes between the initial acceleration 86 of the closure element 49 at the beginning of the opening movement and the negative final acceleration 90 at the end of the opening movement. In this case, a longer opening time t or a shorter opening time t passes depending on the current viscosity of the glue surrounding the closure element 49.

The measurement results of the opening time run into the control and/or regulation of the respective glue valve 27 or glue valve group 26 by the period of time of the application of the opening force, i.e. the period of time in which the opening current 88 flows, being matched in each case to the measured opening time. In the present exemplary embodiment, the period of time in which the opening current flows through the solenoid 57 is equivalent to the measured opening time.

As already described, the viscosity of the glue is lower the higher the glue temperature is. With conditions otherwise identical, this results in correspondingly larger drops of glue which pass to the outside through the valve opening 47. In order nevertheless to achieve a constant drop of glue size, for example at a glue temperature which increases over the course of time during the production process, the times within which the glue valve 27 is opened have to be correspondingly matched to the changing viscosity or to the changing glue temperature. Accordingly, in the event of a reducing viscosity of the glue, the closure element 49 of the glue valve 27 is held for in each case lower spans of time in the open position permitting the outlet of glue, in order to obtain a constant spot of glue size. The period of time in which the holding current 91 flows through the solenoid 57 is correspondingly suitably lengthened or shortened.

Figure 5:
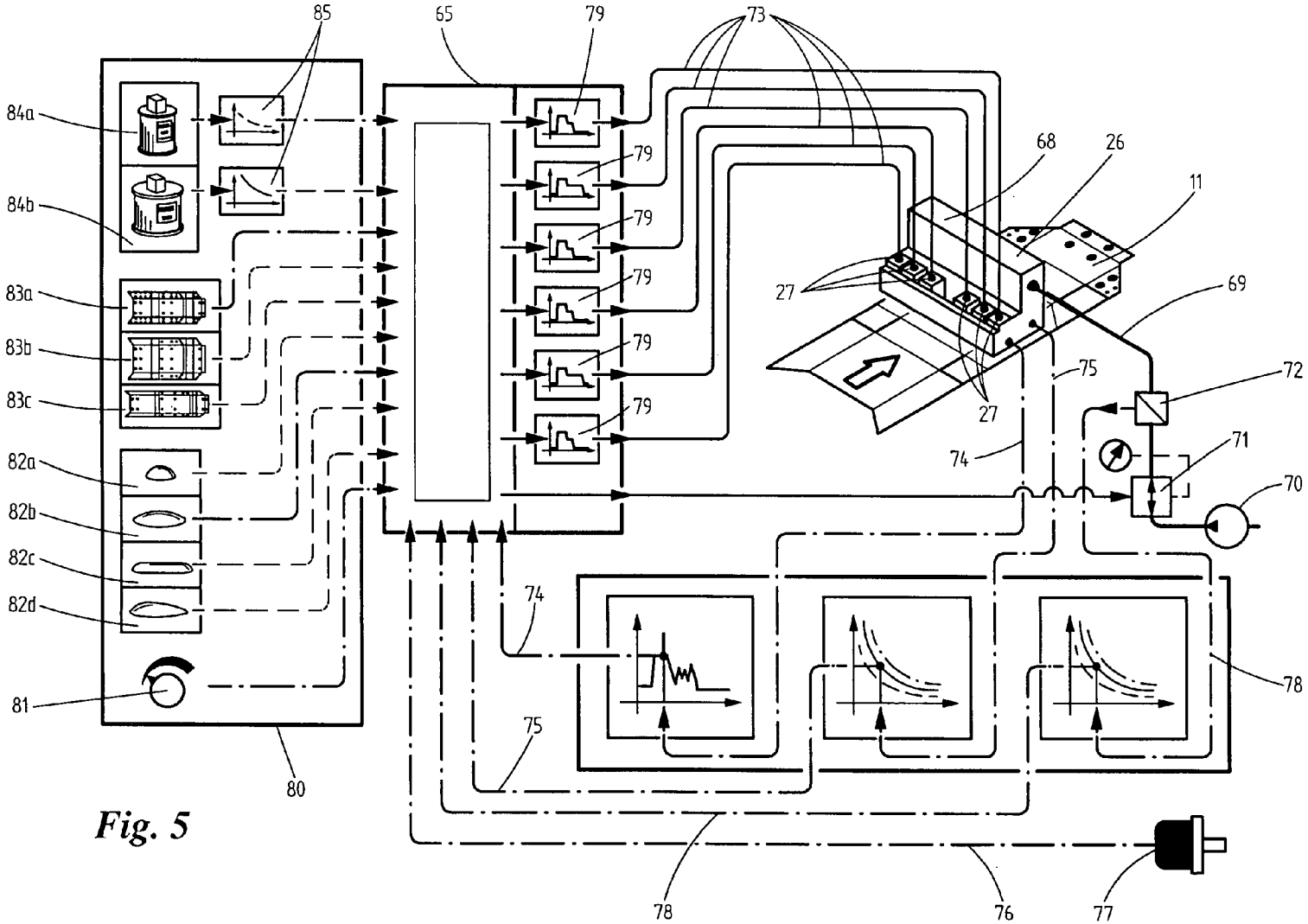
FIG. 5 shows a schematic illustration of the control/regulating operations during the control/regulation of a group of glue valves according to FIGS. 1-3, and FIG. 6*a* and FIG. 6*b* show two schematic illustrations of magnetic forces acting in the valve.

It is schematically illustrated in FIG. 5 by means of a chain-dotted arrow that the corresponding acceleration signals 74 of each of the glue valves 27 are detected. The acceleration signals 74 are transmitted to the control and/or regulating device 65 at the inputs thereto. In a corresponding manner, the temperature signals 75 which originate from the respective temperature sensors 62 are likewise communicated to the control and/or regulating device 65. As an alternative, it is, of course, possible for only one of the glue valves 27 of the group valve 26 to be provided with the corresponding sensors 62, 66. This selected glue valve would then be used as representative of the other glue valves 27, and the other glue valves 27 would be controlled and/or regulated in an analogous manner as a function of the measurement results at the selected glue valve 27.

The machine rotational speed 76 is supplied as a further input variable to the control and/or regulating device 65. The machine rotational speed is measured in a customary manner via a machine rotational speed sensor 77.

Finally, pressure signals 78 produced by the pressure sensor 72 are also transmitted as input variables to the control and/or regulating device 65.

The abovementioned input variables are processed and evaluated in the control and/or regulating device 65. Control signals are supplied to the valves 27 via the control lines 73 as a function of the input variables. Specifically, control signals are supplied which influence the current flowing through the respective solenoid 57 of the respective valve 27, namely both with respect to the current strength and with respect to the corresponding times at which the current flows, and with respect to the spans of time of the flow of current.

For this purpose, depending on the input variables, the control and/or regulating device 65 may make recourse to stored control curves 79. The latter specify current strengths as a function of time, to which the respective solenoid 57 of the respective valve 27 is subjected. In principle, it is also conceivable for the control and/or regulating device 65 to automatically calculate control signals of this type as a function of specified laws.

For the selection of the control curves 79 or for calculating same, the control and/or regulating device 65 makes recourse to a database 80 in which a very wide variety of sets of parameters associated with the cigarette pack 10 to be produced and with the blank 11 to which glue is to be applied are stored, in particular in a selectable manner. Said set of parameters may include, for example, the machine speed 81. Furthermore, the data memory 80 may include different drop of glue sizes 82*a*-82*d*.

The operator can therefore select, for example, which size of drop should be set for the blank in question. Said selection can take place individually in particular for each individual valve 27 of the group valve 26.

Furthermore, different spot of glue patterns 83*a*-83*c* can be deposited in the database 80. The operator can select a spot of glue pattern 83 suitable for the respective blank 11 to which glue is to be applied. The glue valves 27 and the glue valve group 26 are correspondingly controlled.

The type of glue 84 may also be a parameter which is included in the selection of the control curves 79 or in the calculation of same. Thus, various viscosity/temperature curve profiles 85, to which the control and/or regulating device 65 makes recourse, can be deposited as a function of types of glue 84*a*, 84*b*.

Figure 6B:
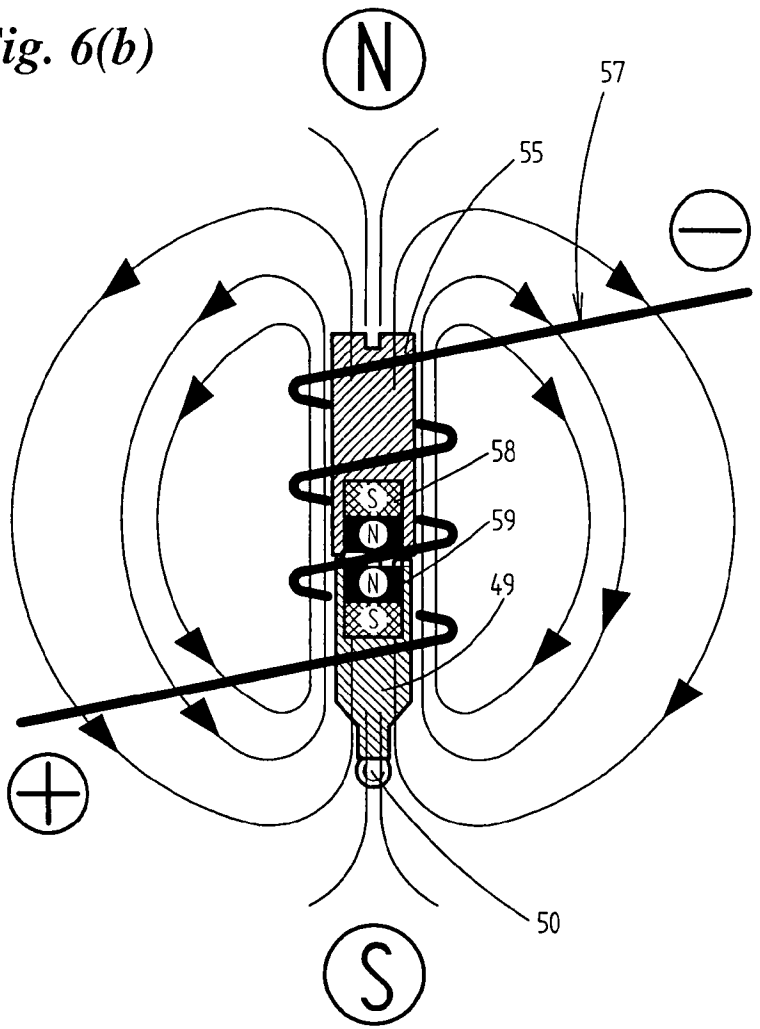
Figure 6A:
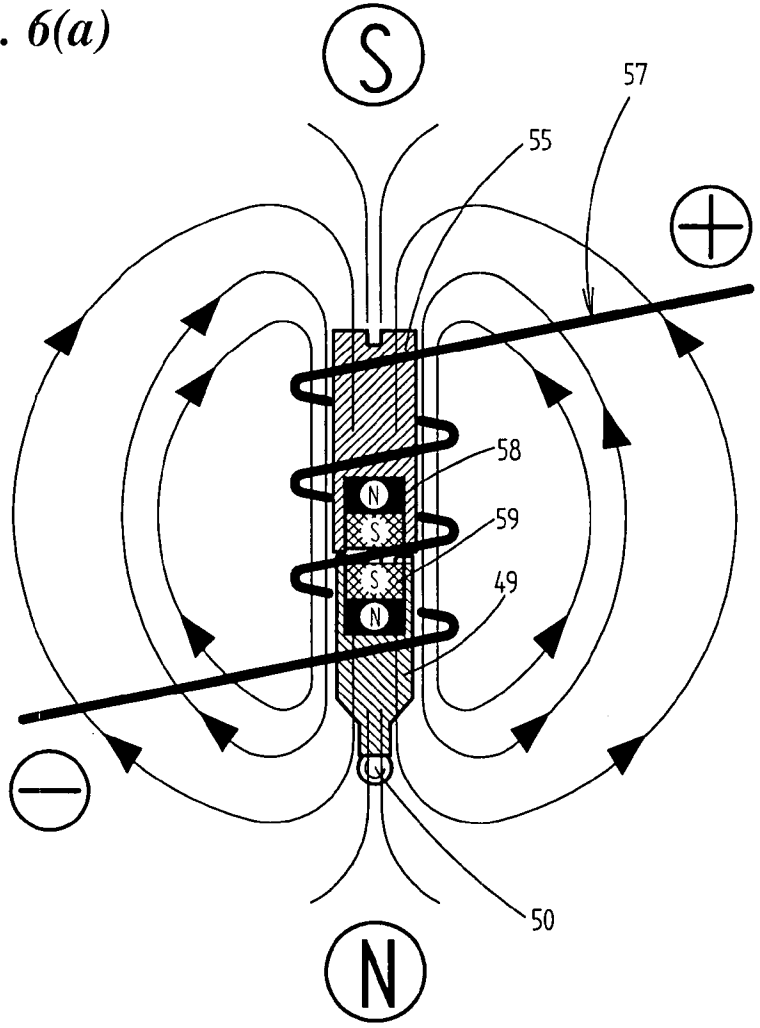

Finally, a further important aspect of the invention is explained with reference to FIGS. 6*a* and 6*b*. Said aspect relates to the alignment of the individual magnets 58, 59 of the valve 27. It has been shown in trials that the desired closing movement of the closure element 49, which closing movement is brought about by the solenoid 57, is obtained primarily in the constellations illustrated in FIGS. 6*a*, 6*b*:

In the constellation according to FIG. 6*a*, the individual magnets 58, 59 are arranged in such a manner that the south poles thereof are directly opposite each other. In this case, an opening movement of the valve 27 can be initiated primarily whenever the flow of current through the winding of the solenoid 57, which winding surrounds at least sections of the threaded bolt 55 and the closure element 49, leads by means of suitable polarity of the current source of the solenoid 57 to a magnetic field, the north pole of which is arranged adjacent to the closing body 50 of the closure element 49 whereas the south pole of which is arranged on the correspondingly opposite side of the solenoid 57, namely adjacent to the upper side of the threaded bolt 55.

By contrast, in the constellation according to FIG. 6*b*, the individual magnets 58, 59 are arranged in such a manner that the north poles thereof are directly opposite each other. In this case, an opening movement of the valve 27 can be initiated primarily whenever the flow of current through the solenoid 57 results in a magnetic field, the south pole of which is arranged adjacent to the closing body 50 of the closure element 49. By contrast, in this case, the north pole of said magnetic field is correspondingly arranged on the opposite side of the solenoid 57, namely adjacent to the upper side of the threaded bolt 55.

LIST OF REFERENCE NUMBERS

10 Pack
11 Blank
12 Lower box part
13 Lid
14 Line joint
15 Front wall

16 Bottom wall
17 Rear wall
18 Interior side tab
19 Exterior side tab
20 Lid rear wall
21 End wall
22 Lid front wall
23 Lid inner tab
24 Inner lid side tab
25 Outer lid side tab
26 Group of glue valves
27 Glue valve
28*a*-28*b* Smaller spots of glue
29*a*-29*f* Larger spots of glue
30 Blank unit
31 Magazine
32 Rolling wheel
33 Conveyor track
34 Upper guide
35 Lower guide
36 Pair of rollers
37 Pair of rollers
38 Folding turret
39 Pocket
40 Adjusting arm
41 Punch
42 Folding wall
43 Shaft
44 Collar
45 Valve housing
46 Glue line
47 Valve opening
48 Valve seat
49 Closure element
50 Closing body
51 Intermediate piece
52 Piston piece
53 Valve chamber
54 Interior space
55 Threaded bolt
56 Seal
57 Solenoid
58 Individual magnet
59 Individual magnet
60 Spacer piece
61 Interruptions
62 Temperature sensor
63 Measuring head
64 Cable connection
65 Control/regulating device
66 Acceleration sensor
67 Cable connection
68 Carrier
69 Common glue feed
70 Feed pump
71 Pressure regulator
72 Pressure sensor
73 Control line
74 Acceleration arrow
75 Temperature signals
76 Machine rotational speed
77 Machine rotational speed sensor
78 Pressure signals
79 Control curve
80 Database
81 Machine speed
82*a*-82*d* Drop of glue sizes
83*a*-83*c* Spot of glue patterns
84*a*-84*b* Types of glue
85 Viscosity/temperature curves
86 Accelerated initial movement
87 Acceleration/time diagram
88 Opening current
89 Current/time diagram
90 Negatively accelerated final movement
91 Holding current

The invention claimed is:

1. A method for producing packs (10) from blanks (11, 44), comprising the steps of:

connecting individual regions of a pack blank (11) to one another and, if appropriate, to one or more separate blanks (44), wherein the pack blank (11) and/or the separate blank (44) are provided in regions with individual, spatially separated drops of glue (28, 29) by means of at least one glue valve (27);

subsequently holding or pressing the blank regions that are to be adhesively bonded together on one another; and applying the individual, spatially separated drops of glue (28, 29) for adhesively bonding together the individual blank regions in a targeted manner in at least two different portion sizes or quantities of glue to the respective pack blank (11) and/or to the respective separate blank (44), wherein in border regions of at least one folding tab (19, 25) of the pack blank smaller drops of glue are applied than in further inward regions of the at least one folding tab (19, 25).

2. The method as claimed in claim 1, wherein, in order to connect the separate blank (44) to the pack blank (11), individual drops of glue (29*c*, 29*d*) are applied, which drops of glue are larger than the drops of glue (28) that are applied in the border regions of the at least one folding tab (19, 25).

* * * * *

UNITED STATES PATENT AND TRADEMARK OFFICE

CERTIFICATE OF CORRECTION

PATENT NO. : 8,690,744 B2
APPLICATION NO. : 12/995611
DATED : April 8, 2014
INVENTOR(S) : Harms et al.

It is certified that error appears in the above-identified patent and that said Letters Patent is hereby corrected as shown below:

On the title page item (73), should read as follows:

Focke & Co. (GmbH & Co. KG), Verden (DE)

Signed and Sealed this
First Day of July, 2014

Michelle K. Lee

Michelle K. Lee
*Deputy Director of the United States Patent and Trademark Office*